United States Patent [19]

McNamara

[11] Patent Number: 4,800,241

[45] Date of Patent: Jan. 24, 1989

[54] PROXIMITY SWITCH MOUNTING PLATE

[75] Inventor: James A. McNamara, Willowdale, Canada

[73] Assignee: Allied Automation Systems, Inc., Detroit, Mich.

[21] Appl. No.: 121,333

[22] Filed: Nov. 16, 1987

[51] Int. Cl.[4] ..... H01H 35/38

[52] U.S. Cl. ..... 200/82 E; 335/205; 200/294

[58] Field of Search ..... 200/82 R, 82 E, 294, 200/303, 47; 91/1; 92/5 R; 335/205; 340/626; 307/118; 361/178–181; 269/32, 93, 228, 233

[56] References Cited

U.S. PATENT DOCUMENTS

| | | | |
|---|---|---|---|
| 4,086,456 | 4/1978 | Bone | 200/82 E |
| 4,161,685 | 7/1979 | Jacob | 335/205 |
| 4,594,487 | 6/1986 | Grassl et al. | 200/82 E |
| 4,608,870 | 9/1986 | Huber | 200/82 E |
| 4,664,364 | 5/1987 | Lymburner | 200/82 E |
| 4,680,436 | 7/1987 | Brausfeld | 200/82 E |
| 4,752,657 | 6/1988 | Kane | 200/82 E |

*Primary Examiner*—Gerald P. Tolin

*Attorney, Agent, or Firm*—Basile and Hanlon

[57] ABSTRACT

The mounting plate for a proximity switch for sensing the position of a piston within a fluid operated, expansible chamber cylinder. The mounting plate comprises a flat portion with two notches formed therein adjacent opposite sides thereof and an arcuate flange adjoining the flat portion having means forming an aperture therein. The proximity switch is mounted onto the tie rod of the expansible chamber cylinder, with the mounting plate interposed therebetween with the arcuate flange thereof positioned to be concentric with and spaced apart from the surface of the expansible chamber cylinder. A threaded fastening device is inserted through the aperture and turned until the proximity switch is correctly positioned.

4 Claims, 1 Drawing Sheet

PROXIMITY SWITCH MOUNTING PLATE

BACKGROUND OF THE INVENTION

1. Field of the Invention

This invention relates in general to the field of proximity switches for sensing the position of a piston within a fluid operated, expansible chamber cylinder, and more specifically to the field of a mounting plate which provides a secure, vibration-resistant mounting of the proximity switch to the cylinder.

2. Description of the Prior Art

In the use of fluid operated, expansible chamber cylinders, it has been common to use magnetic switches for sensing the position of the piston within the cylinder. The magnetic switch is typically a magnetic reed switch and opens and closes in response to a magnetic flux produced by a permanent magnet attached to a piston within the cylinder. Movement of the piston and the magnet carried thereon varies the magnetic flux and opens and closes the associated reed switch. Proximity switches of this type are very widely used for such applications as automatic cylinder cycling, light indication, cylinder programming and sequencing, multiposition signalling, machining applications, etc. Their use permits the elimination of a large number of mechanical elements formally associated with the use of mechanical limit switches, such as auxiliary gears, spiral rod extensions, switch dogs, mounting plates and cams.

Conventional proximity switches, such as those commercially available under the name Parker Fluidpower, are mounted on a tie-rod extending between the cylinder heads secured to each end of the cylinder. The proximity switch is provided with a retaianing channel formed on one side thereof which is engageable with the tie-rod. A plurality of threaded bores, typically two, are formed in the proximity switch and extend through the rear adjusting surface of the retaining channel. Externally threaded fastening devices are provided which are engageable with the threaded bores. These fastening devices are, typically, bolts and nuts. The proximity switch is mounted to the cylinder by engaging the tie-rod in the retaining channel and tightening down the fastening devices until they abut tightly against the tie-rod.

Due to the manner of mounting the proximity switch, the device is subject to several types of failure in operation. Since the piston typically operates at high speeds, considerable vibration occurs in the body of the cylinder. The vibration tends to loosen the fastening devices, thus causing the proximity switch to slip and rotate around the tie-rod. Because of this rotation, the proximity switch is no longer positioned against a surface of the cylinder. An air gap is formed between the switch and the magnet disposed on the piston inside the cylinder and diminishes the magnitude of the magnetic flux experienced by the switch as the magnet passes by. This greatly diminishes the performance of the proximity switch.

In addition, since the proximity switch carries a number of electrical leads extending therefrom, it may easily be dislodged by accidental pulling or jerking of the leads. The force exerted on the leads will cause the switch to pivot around the tie rod into a dislodged position.

Several solutions have been proposed to this problem of slippage of the proximity switch, but all have proven unsatisfactory or impractical. Serrations have been provided to better grip the tie-rod. U.S. Pat. No. 4,086,456 proposes providing a tie-rod of hexagonal cross-section, instead of the typical circular cross-section. The proximity switch is provided with a first gripping surface which engages the tie-rod to position the switch with respect to the cylinder. A fastening plate is provided which has a second gripping surface for engaging the tie-rod and positioning the proximity switch. The plate is then tightened against the proximity switch by means of a fastening device. One of the surfaces of the proximity switch is made arcuate in shape to securely engage the surface of the cylinder.

U.S. Pat. No. 4,594,487 discloses another approach to the problem. The mounting arrangement disclosed therein comprises a sensing means support device adapted to be detachably mounted on a fluid power cylinder. The sensing means support device comprises a clamp member for detachable connection to the tie rods and a swivel member pivotally supported by a clamp member. The swivel member is positioned in overlying relation to a portion of the outer peripheral surface of the cylinder body when the sensing means support device is mounted on the fluid power cylinder. The swivel member is adapted to support the proximity switch contiguous the outer peripheral surface of the cylinder body. The clamp member is provided with a notched contour adapted to fit over tie rods of different diameters, and is also provided with a hook profile which adapts the clamp member to be easily moved to any desired adjusted position along the tie rod and to be tightened into engagement therewith and with the outer surface of the fluid cylinder.

While the above-referenced patent may be successful in providing a secure, vibration resistant mounting of the proximity switch to the cylinder, the devices disclosed therein are not usable with the standard type of proximity switch and/or the standard type of tie-rod provided on a fluid cylinder. Thus, the problem of slippage with the standard type of proximity switch continues to exist.

It would be desirable to provide a simple means of securely mounting a proximity switch to a fluid cylinder which will resist dislodgement of the proximity switch due to vibration.

It would also be desirable to provide such a secure, vibration resistant mounting which may be used with a standard type of proximity switch and a fluid cylinder provided with a standard, circular tie-rod.

SUMMARY OF THE INVENTION

What is provided is a mounting plate mounted to a proximity switch, as is conventional, for sensing the position of a piston within a fluid operated, expansible chamber cylinder, wherein the mounting plate comprises a flat portion and a flange adjoining the flat portion. Either the flange or the flat portion is provided with at least one aperture and a fastening device is threaded through each such aperture.

Typically, the proximity switch is of the type provided with a retaining channel formed on a side thereof and engageable with a tie-rod extending between heads secured to each end of the cylinder and a plurality of externally threaded fastening devices engageable with a plurality of threaded through bores formed in the rear adjusting surface of the retaining channel. The proximity switch may be positioned with respect to the cylinder by engaging the tie-rod in the retaining channel. In this embodiment, the mounting plate further comprises two tabs formed adjacent opposite edges of the flat portion, said tabs being adapted to abut the end of the rear adjusting surface of the retaining channel. The flange is arcuate in cross-section. When the tabs are abutted against the retaining channel with the arcuate flange aligned co-axially with respect to and spaced apart from the surface of the cylinder and the proximity switch is positioned with respect to the cylinder by means of engagement of the tie-rod in the retaining channel, tightening down of the fastening device will cause it to abut a portion of the surface of the cylinder, thereby preventing displacement of the proximity switch with respect to the cylinder. By using a vibration-proof nut provided with a nylon collar on the fastening device, an even more secure mount may be provided.

Fluid cylinders commonly come in a number of standard sizes. Since the arcuate portion of the mounting plate does not actually engage the surface of the cylinder, the mounting device can be used for mounting a standard proximity switch to many different standard sized fluid cylinders. It is not necessary that the degree of curvature of the arcuate portion match the degree of curvature of the surface of the cylinder.

BRIEF DESCRIPTION OF THE DRAWING

The various features, advantages and other uses of the present invention will become more apparent by referring to the following detailed description and drawing in which.

DETAILED DESCRIPTION OF THE PREFERRED EMBODIMENT

Figure 1:
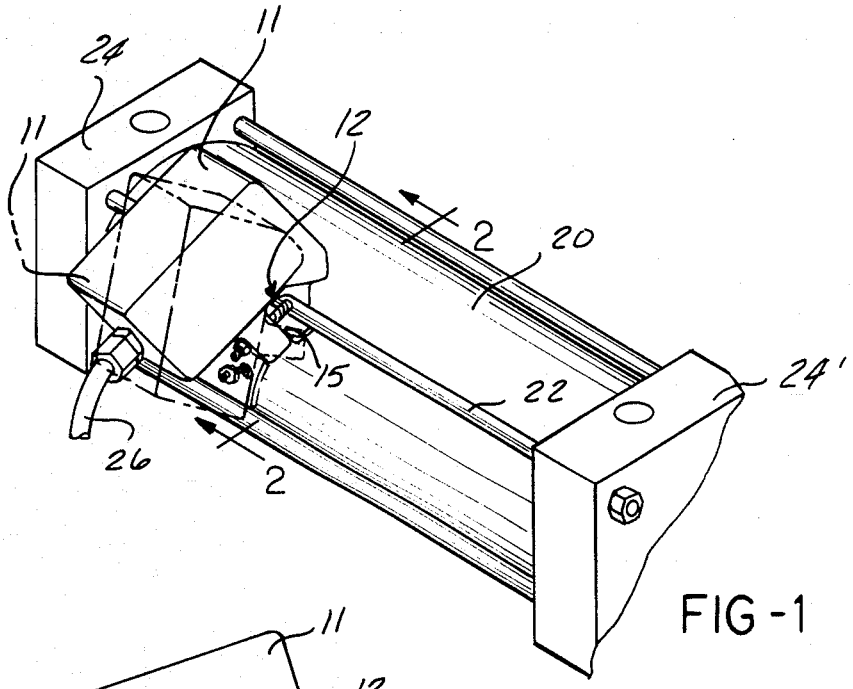
FIG. 1 is a perspective view of a proximity switch mounted to a fluid operated, expansible chamber cylinder, showing in phantom the proximity switch after it has slipped from its correct position due to operation of the fluid cylinder.

Throughout the following description and drawing, identical reference numbers are used to refer to the same components shown in multiple figures of the drawing.

Figure 2:
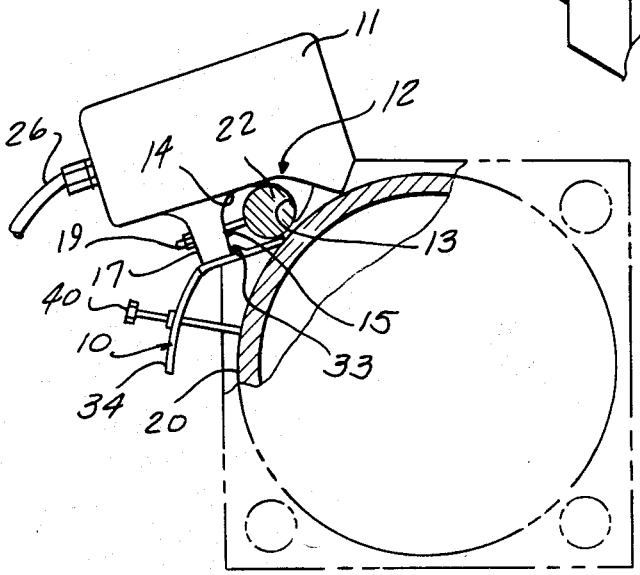
FIG. 2 is a sectional view of the proximity switch and cylinder of FIG. 1 showing the mounting plate of the present invention.

Referring now to the drawing, and to FIGS. 1 and 2 particular, there is illustrated a standard proximity switch 11 for use in sensing the position of a piston within a fluid operated, expansible chamber cylinder. The proximity switch 11 has formed on the lower surface thereof a retaining channel, denoted generally by 12. This retaining channel includes a front gripping surface 13, a top surface 14, and a rear adjustable surface 15. Threaded through bores 17 are formed in the proximity switch 11 and extend through the rear adjusting surface 15 of the retaining channel 12. Fastening devices 19, which are depicted as threaded bolts carrying vibration-proof nuts provided with nylon collars, are threadingly engageable with through bores 17.

Standard proximity switch 11 has heretofore been mounted to fluid cylinder 20 in the manner depicted in FIG. 1. Retaining channel 12 is positioned on tie-rod 22 which extends between cylinder heads 24 and 24' secured to each end of cylinder 20. When proximity switch 11 is correctly positioned with respect to cylinder 20, part of proximity switch 11 will be in direct contact with the surface of cylinder 20. By tightening down fastening devices 19 which are threadingly engaged with through bores 17, fastening devices 19 will abut the tie-rod 22, thereby causing the proximity switch 11 to be secured in the correct position. However, as depicted by the phantom lines in FIG. 1, the vibrations caused by continual operation of cylinder 20 will cause fastening devices 19 to loosen to the point where they no longer tightly abut against tie-rod 22. Since the tight abutment between fastening devices 19 and tie-rod 22 is the only securing point for proximity switch 11 with respect to cylinder 20, the loss of the tight abutment due to the vibrations will cause proximity switch 11 to slip from its correct position to the position indicated by the phantom lines. In the slipped position depicted, the body of proximity switch 11 is no longer directly in contact with the surface of cylinder 20. This lack of contact severely impairs the performance of proximity switch 11.

Figure 3:
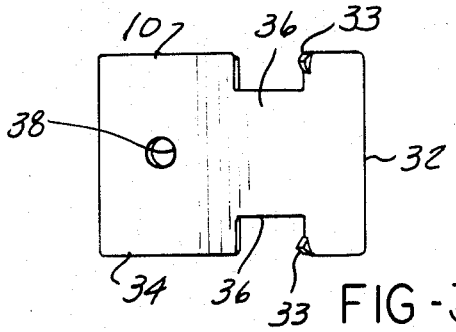
FIG. 3 is a top plan view of the plate of FIG. 2.
Figure 4:
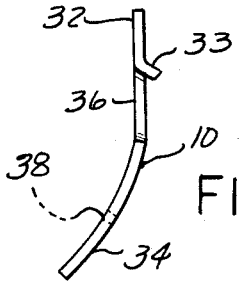
FIG. 4 is a side elevational view of the mounting plate of FIG. 2.

A proximity switch mounting plate 10 constructed in accordance with the instant invention is depicted in FIGS. 3 and 4. The proximity switch mounting plate 10 is comprised of a flat portion 32 having two notches 36 formed therein adjacent opposite edges thereof. Each of the notches 36 has a triangular tap 33 projecting therefrom. The tabs 33 are adapted to abut the end of the rear adjusting surface 15 of the retaining channel 12. Proximity switch mounting plate 10 further comprises an arcuate flange 34 adjoining the flat portion 32 and has an aperture 38 formed therein. A fastening device 40, which is seen is FIG. 2, is threaded through aperture 38.

With the aid of mounting plate 10, proximity switch 11 may be mounted to cylinder head 20 in a secure and vibration resistant manner. FIG. 2 illustrates how the device of the present invention is employed to provide such a secure and vibration resistant mounting. FIG. 2 is a cross-sectional view of the cylinder 20 of FIG. 1 taken at lines 2—2, showing a proximity switch 11 mounted thereto with the aid of proximity switch mounting plate 10. Proximity switch 11 is mounted to tie rod 22 of cylinder 20 in the usual manner, except that fastening devices 19 are not completely tightened down but are left loose enough so that proximity switch 11 is free to pivot around tie rod 22. Then, proximity switch mounting plate 10 is mounted to the switch and is interposed between proximity switch 11 and the surface of cylinder 20, with the arcuate flange 34 of mounting plate 10 positioned such that it is concentric with and spaced apart from the outer surface of cylinder 20. This position is achieved by abutting the rear adjusting surface 15 of the retaining channel 12 against tabs 33, as depicted in FIG. 2. Threaded fastening device 40 is then turned until the proximity switch 11 is positioned correctly with respect to cylinder 20. Fastening devices 19 are then tightened down to help secure the proximity switch in this position. The presence of mounting plate 10 will cause proximity switch 11 to be positioned in the correct manner so that it contacts the surface of cylinder 20. The end of fastening device 40 will abut the outside surface of cylinder 20. Hence, instead of merely relying on the abutment of fastening devices 19 against the tie-rod 22, the use of mounting plate 10 provides a much more secure, two-point mounting to proximity switch 11. Because the mounting plate 10 prevents proximity switch 11 from pivoting around the rod 22, proximity switch 11 will be unable to slip out of the position, even if fastening devices 19 become loosened due to operation of cylinder 20.

In order to achieve the secure mounting of the proximity switch, it is desirable that the mounting plate be comprised of a substantially non-resilient material. Preferably, the non-resilient material is a metal such as galvanized steel.

Because proximity switch 11 is normally equipped with leads 26 extending therefrom, such a switch 11 mounted as depicted in FIG. 1 will be especially prone to slip out of position should any force be exerted on proximity switch 11 through leads 26. If leads 26 are, for example, accidentally pulled or stretched, proximity switch 11 is free to pivot around the tie-rod 22, especially if fastening devices 19 are even only slightly loose. In contrast, any force exerted by displacement of leads 26 on the proximity switch 11 mounted in the manner depicted in FIG. 2 will not cause such slippage and displacement. Due to the presence of mounting plate 10, proximity switch 11 is no longer free to pivot around tie-rod 22. Thus, a proximity switch mounted with the device of the instant invention provides a secure mounting to the fluid cylinder which is not only resistant to vibration, but will not be dislodged due to extraneous axial or rotational forces exerted thereon.

While the herein disclosed invention has been described with reference to certain embodiments and exemplifications thereof, it is not intended to be so limited but solely by the claims appended hereto.

I claim:

1. A mounting plate mounted to a proximity switch which senses the position of a piston within a fluid operated, expansible chamber cylinder, said proximity switch being provided with a retaining channel formed on a side thereof and engaged with a tie-rod extending between heads secured to each end of the cylinder and a plurality of externally threaded first fastening devices engageable with a plurality of threaded bores formed therein and extending through the rear adjusting surface of the retaining channel, wherein the proximity switch is positioned with respect to the cylinder by engaging the fastening devices with the tie-rod in the channel, the mounting plate comprising:

a flat portion having two tabs formed adjacent opposite edges thereof, said tabs abutting the end of the rear adjusting surface of the retaining channel;

an arcuate portion adjoining the flat portion having means forming an aperture therein;

a second fastening device threaded through the aperture, wherein the acruate portion is aligned coaxially with respect to and spaced apart from the surface of the cylinder and the proximity switch is positioned with respect to the cylinder by engagement of the tie-rod in the channel, the second fastening device abuts the surface of the cylinder thereby preventing dislodgement of the proximity switch with respect to the cylinder.

2. The mounting plate of claim 1 wherein the flat portion further comprises a notch formed on the opposite edges thereof medial of the tab.

3. The mounting plate of claim 1 wherein the mounting plate is comprised of a substantially non-resilient material.

4. The mounting plate of claim 3 wherein the non-resilient material is a metal.

* * * * *